United States Patent [19]

Wilhelm et al.

[11] Patent Number: 4,519,586

[45] Date of Patent: May 28, 1985

[54] LIFETIME LIVESTOCK FENCE POST

[76] Inventors: Stanley R. Wilhelm; George Spector, both of 233 Broadway Rm. 3615, New York, N.Y. 10007

[21] Appl. No.: 594,370

[22] Filed: Mar. 28, 1984

[51] Int. Cl.[3] ..... E04H 17/02

[52] U.S. Cl. ..... 256/51; 256/19

[58] Field of Search ..... 256/19, 50, 51, 57, 256/48

[56] References Cited

U.S. PATENT DOCUMENTS

| | | | |
|---|---|---|---|
| 228,037 | 5/1880 | Climie | 256/51 |
| 377,323 | 1/1888 | Miller | 256/57 X |
| 821,535 | 5/1906 | Perkins | 256/51 |
| 888,719 | 5/1908 | Mendenhall | 256/51 X |
| 911,584 | 2/1909 | Ford | 256/51 |
| 967,691 | 8/1910 | Walther | 256/51 |
| 1,591,796 | 7/1926 | Thompson | 256/50 |
| 2,618,037 | 11/1952 | Miller | 256/19 X |
| 2,641,448 | 6/1953 | Duke | 256/19 X |
| 4,142,711 | 3/1979 | Brimhall | 256/19 X |

*Primary Examiner*—Andrew V. Kundrat

[57] ABSTRACT

A fence post is provided and consists of a plurality of relatively short transverse pins longitudinally spaced and secured within a reinforced concrete body portion to project from a curved face of the body portion whereby each pin has a head portion outside of the body portion defining a space therebetween for a fencing wire to sit upon to be secured to the body portion.

1 Claim, 6 Drawing Figures

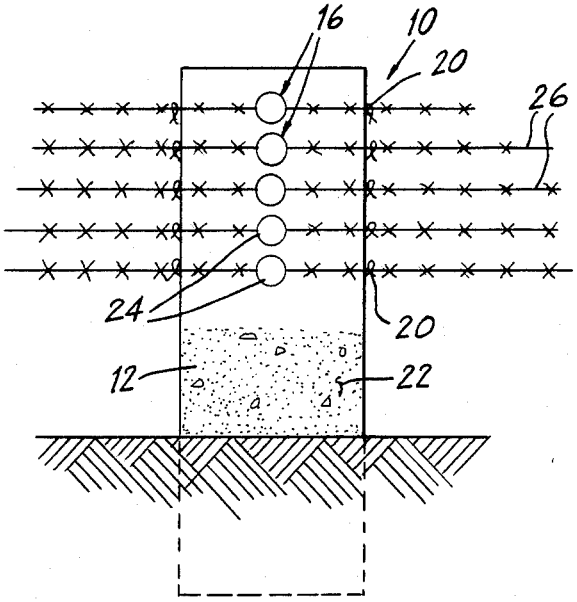
FIG.1
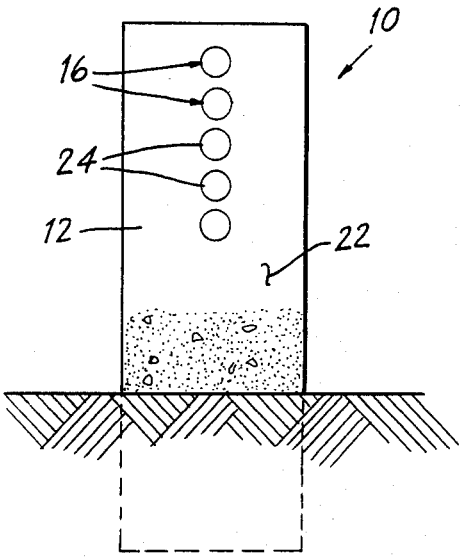
FIG.2
FIG 3
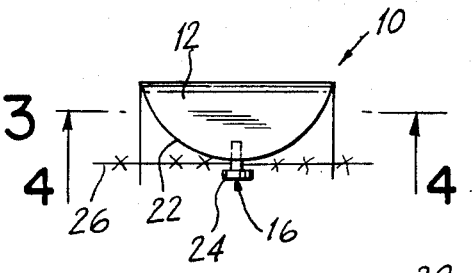
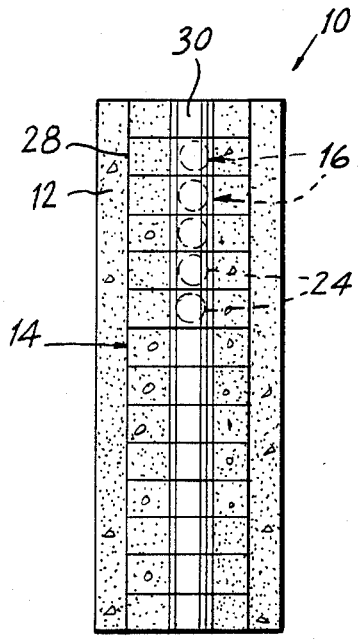
FIG.4
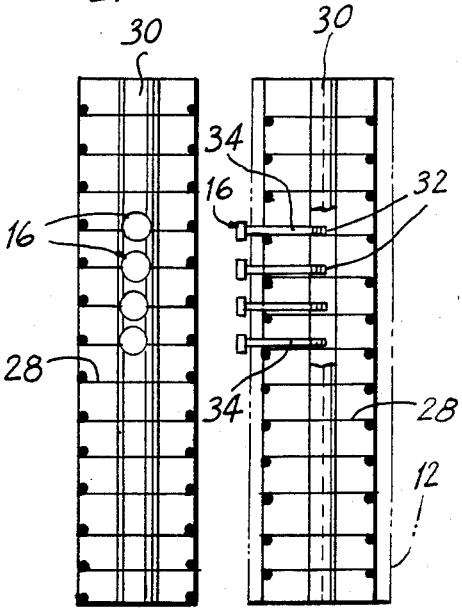
FIG.5 FIG.6

LIFETIME LIVESTOCK FENCE POST

BACKGROUND OF THE INVENTION

The instant invention relates generally to fence posts and more specifically it relates to a fence post made out of reinforced concrete to support fencing wire.

Numerous fence posts have been provided in prior art that are adapted to support wire strand fencing. For example U.S. Pat. Nos. 1,646,909; 2,641,448 and 2,785,876 all are illustrative of such prior art. While these units may be suitable for the particular purpose to which they address, they would not be suitable for the purposes of the present invention as heretofore described.

SUMMARY OF THE INVENTION

A principle object of the present invention is to provide a fence post formed of reinforced concrete having pins projecting from a curved face of the post onto which fencing wire may be engaged.

Another object is to provide a fence post that can have the fencing wire secured quickly thereto without the use of special tools.

An additional object is to provide a fence post having the pins secured directly to a reinforcing rod so that they will be in proper position when the post is formed.

A further object is to provide a fence post that is simple and easy to use.

A still further object is to provide a fence post that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front elevational view of the invention with pin heads projection therefrom showing fencing wire connected thereto.

FIG. 2 is a similar view to FIG. 1 with the fencing wire removed.

FIG. 3 is a top view of the fence post showing its curvate shape.

FIG. 4 is a vertical cross sectional view taken along line 4—4 in FIG. 3 showing internal construction.

FIG. 5 is a front elevational view of a modification showing the wire cage, reinforcing bar and transverse pins.

FIG. 6 is a side elevational view of FIG. 5 with parts broken away showing the pins screwed into the reinforcing bar, sitting on the wire cage and projecting beyond the concrete body portion shown in phantom lines.

DETAILED DESCRIPTION OF THE PREFERRED EMBODIMENTS

Turning now descriptively to the drawings, in which similar reference characters denote similar elements throughout the several views, FIGS. 1 through 4 illustrates a fence post 10 that consists of an elongated concrete body portion 12, a reinforcing assembly 14, relatively short transverse pins 16 and tie wires 20.

The body portion 12 has at least one curved face 22 extending longitudinally thereof while the reinforcing assembly 14 is to increase strength of the body portion 12. The pins 16 are longitudinally spaced and secured within the body portion 12 to project from the curved face 22. Each pin 16 has a head portion 24 outside of the body portion defining a space therebetween for a fencing wire 26 such as barb wire to sit upon. The tie wires 20 are for securing the fencing wire to the body portion.

The reinforcing assembly 14 consists of an elongated galvanized wire cage 28 longitudinally disposed in the body portion 12 and an elongated reinforcing bar 30 longitudinally disposed in center of the body portion.

The tie wires 20 are longitudinally spaced and encircle the body portion whereby each tie wire engages one fencing wire 26 on opposite sides of the body portion 12 as best seen in FIG. 3.

FIGS. 5 and 6 show a modified form of the invention. The elongated reinforcing bar 30 has a plurality of longitudinally spaced transverse threaded apertures 32. Each transverse pin 16 has a threaded shaft 34 to engage one threaded aperture 32 of the reinforcing bar 30 so that the transverse pins will be in proper position extending through the wire cage 28 when the body portion 12 shown in phantom in FIG. 6 is formed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A fence post which comprises:

(a) an elongated concrete body portion having at least one curved face extending longitudinally thereof;

(b) means for reinforcing said body portion to increase strength of said body portion;

(c) a plurality of relatively short transverse pins longitudinally spaced and secured within said body portion to project from said curved face of said body portion, each said transverse pin having a head portion outside of said body portion defining a space therebetween for a fencing wire to sit upon; and (d) means for securing said fencing wire to said body portion wherein said means for reinforcing said body portion comprises;

(a) an elongated galavanized wire cage longitudinally disposed in said body portion; and (b) an elongated reinforcing bar longitudinally disposed in center of said body portion, wherein said means for securing said fencing wire to said body portion comprises a plurality of tie wires longitudinally spaced and encircling said body portion whereby each said tie wire engages one said fencing wire on opposite sides of said body portion, further comprising:

(a) said elongated reinforcing bar having a plurality of longitudinally spaced transverse threaded apertures; and (b) each said transverse pin having a threaded shaft to engage one said threaded aperture of said reinforcing bar so that said transverse pins will be in proper position extending through said wire cage when said body portion is formed, (c) each of said pin transversely engaging said cage thereby supporting said pin in desired position prior to pouring concrete to form said post.

* * * * *